US009668637B2

(12) United States Patent
Lee et al.

(10) Patent No.: US 9,668,637 B2
(45) Date of Patent: Jun. 6, 2017

(54) NOZZLE ASSEMBLY FOR A DISHWASHER

(71) Applicant: SAMSUNG ELECTRONICS CO., LTD., Suwon-si (KR)

(72) Inventors: Chang Wook Lee, Seoul (KR); Jung Yoon Hahm, Yongin (KR); Hyung Kwen Ham, Jecheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 803 days.

(21) Appl. No.: 13/728,326

(22) Filed: Dec. 27, 2012

(65) Prior Publication Data

US 2013/0180555 A1 Jul. 18, 2013

(30) Foreign Application Priority Data

Jan. 6, 2012 (KR) ..... 10-2012-0002103

(51) Int. Cl.

| | |
|---|---|
| ***A47L 15/23*** | (2006.01) |
| ***A47L 15/42*** | (2006.01) |
| ***B05B 3/06*** | (2006.01) |
| ***B05B 3/04*** | (2006.01) |

(52) U.S. Cl.

CPC ..... *A47L 15/428* (2013.01); *A47L 15/23* (2013.01); *B05B 3/04* (2013.01); *B05B 3/06* (2013.01); *A47L 2401/10* (2013.01); *A47L 2501/30* (2013.01)

(58) Field of Classification Search

CPC .... A47L 15/23; A47L 15/428; A47L 15/4282; B05B 3/008; B05B 3/028; B05B 3/0463; B05B 3/0468; B05B 3/1042

See application file for complete search history.

(56) References Cited

U.S. PATENT DOCUMENTS 3,876,148 A 4/1975 Cushing et al.
4,301,822 A * 11/1981 Dingler ..... B05B 3/06 134/154

(Continued)

FOREIGN PATENT DOCUMENTS

CN 2384571 Y 6/2000
CN 1784485 A 6/2006

(Continued)

OTHER PUBLICATIONS

Extended European Search Report mailed Mar. 13, 2013 for corresponding European Application No. 13150044.9.

(Continued)

*Primary Examiner* — Joseph L Perrin
*Assistant Examiner* — Irina Graf
(74) *Attorney, Agent, or Firm* — Staas & Halsey LLP

(57) ABSTRACT

A nozzle assembly for spraying wash water at an inside a washing tub and a dishwasher having the same, the nozzle assembly including a nozzle configured to rotate on a rotating axis thereof, an inside rotor having a shape of a cylinder and configured to rotate according to a rotation of the nozzle while coupled to the rotating axis, and an outside rotor case having a larger radius than a radius of the inside rotor to accommodate the inside rotor therein, and having an opening hole through which the rotating axis passes, and the rotating axis of the nozzle revolves around a circumference of the opening hole.

28 Claims, 12 Drawing Sheets

(56) References Cited

U.S. PATENT DOCUMENTS

| | | | | |
|---|---|---|---|---|
| 5,697,392 | A * | 12/1997 | Johnson | A47L 15/23 134/176 |
| 2006/0278258 | A1 | 12/2006 | Kara et al. | |
| 2010/0043825 | A1* | 2/2010 | Bertsch | A47L 15/4221 134/18 |
| 2011/0197937 | A1 | 8/2011 | Vanderroest et al. | |

FOREIGN PATENT DOCUMENTS

| | | | |
|---|---|---|---|
| KR | 10-0258618 | | 7/2000 |
| KR | 10-2007-0105045 | | 10/2007 |
| WO | 1040787 | A1 | 10/2000 |

OTHER PUBLICATIONS

Chinese Office Action dated Jul. 13, 2016 in corresponding Chinese Patent Application No. 201310002031.6.
Chinese Office Action issued Mar. 14, 2017 in corresponding Chinese Patent Application No. 201310002031.6, 6 pages.

* cited by examiner

NOZZLE ASSEMBLY FOR A DISHWASHER

CROSS-REFERENCE TO RELATED APPLICATIONS

This application claims the benefit of Korean Patent Application No. 10-2012-0002103, filed on Jan. 6, 2012 in the Korean Intellectual Property Office, the disclosure of which is incorporated herein by reference.

BACKGROUND

1. Field

Embodiments of the present disclosure relate to a nozzle assembly of a dishwasher, and more particularly, to a nozzle assembly capable of evenly spraying wash water at an inside a washing tub and a dishwasher having the same.

2. Description of the Related Art

A dishwasher is configured to spray high-pressure wash water on a dishware to clean the dishware, and goes through a preliminary cleaning, a main cleaning, a rinsing, and a drying stage. In the preliminary cleaning stage, by spraying wash water without the input of a detergent, the residue of dishware is eliminated. In the main cleaning stage, while wash water is sprayed, a detergent is input by a detergent supply apparatus, and thereby the cleaning of the dishware is performed.

A dishwasher includes a body provided with a washing tub at an inside thereof, a movable basket configured to contain dishware and inside the washing tub. A nozzle assembly provided at upper/lower portions of the basket to spray wash water, and the wash water sprayed from the nozzle assembly cleans dishware.

A nozzle assembly is configured to spray wash water while rotating at a fixed position, and in a case when the nozzle assembly is disposed as such, a dead zone to which wash water is not reached is present at an inside the washing tub.

SUMMARY

Therefore, it is an aspect to provide a nozzle assembly configured to spray wash water to a throughout inside a washing tub and a dishwasher having the same.

Additional aspects will be set forth in part in the description which follows and, in part, will be obvious from the description, or may be learned by practice of the disclosure.

In accordance with one aspect, a nozzle assembly includes a nozzle, an inside rotor, and an outside rotor case. The nozzle may be configured to rotate on a rotating axis thereof. The inside rotor may have a shape of a cylinder and configured to rotate according to a rotation of the nozzle while coupled to the rotating axis. The outside rotor case may have a larger radius than a radius of the inside rotor to accommodate the inside rotor therein, and have an opening hole through which the rotating axis passes. The rotating axis of the nozzle may revolve around a circumference of the opening hole.

The rotating axis of the nozzle, while rotating, may revolve around a center of the outside rotor case.

The outside rotor case may include a plurality of outside protrusions protrudedly formed in a radial inward direction from the circumference of the opening hole.

The inside rotor may include a projection protruded from an upper surface of the inside rotor and formed to pass through the opening hole of the outside rotor case.

The inside rotor may further include a plurality of inside protrusions protrudedly formed in an outer radial direction along a circumference of the projection at a side surface of the projection.

The number of the plurality of inside protrusions may be less than the number of the plurality of outside protrusions.

The inside protrusion may be formed in a corresponding shape to an indentation part formed in between the outside protrusions.

The nozzle may include an outlet port through which wash water is sprayed.

The outlet port may be provided in a way that a direction of the wash water sprayed from an upper surface of the nozzle is formed in an inclined manner with respect to an upper surface of the nozzle.

At least one of the nozzle and the inside rotor may be rotated by a reaction against the wash water sprayed from the outlet hole.

In accordance with another aspect, a nozzle assembly includes a nozzle, a rotor, a rotor case and an eccentric rotation guide. The nozzle may be configured to rotate on a rotating axis thereof. The rotor may be configured to rotate according to a rotation of the nozzle while coupled to the rotating axis. The rotor case may be configured to accommodate the rotor and have an opening hole through which the rotating axis passes. The eccentric rotation guide may be formed in a circular-shape plate and have a rotor coupling hole formed to allow the rotor to be coupled while being positioned at a side away from a center of the eccentric rotation guide. The rotating axis of the nozzle, by the eccentric rotation guide, may revolve along a circumference of the opening hole.

The rotor may have inside teeth protrudedly formed in an outward radial direction along a circumference of a side surface of the rotor. The rotor case may have outside teeth protrudedly formed along the circumference of the opening hole in an inward radial direction in a corresponding shape to the inside teeth.

The nozzle may include an outlet port through which wash water is sprayed.

The outlet port may be provided in a way that a direction of the wash water sprayed from the upper surface of the nozzle is formed in an inclined manner with respect to an upper surface of the nozzle.

At least one of the nozzle and the rotor is rotated by a reaction against the wash water sprayed from the outlet hole.

In accordance with another aspect, a dishwasher includes a case, a washing tub, and at least one nozzle assembly. The washing tub may be disposed at an inside the case and accommodating dishware. The at least one nozzle assembly may be configured to spray wash water to an inside the washing tub to clean the dishware at an inside the washing tub. The nozzle assembly may include a nozzle, an inside rotor, and an outside rotor case. The inside rotor may have a shape of a cylinder and configured to rotate according to a rotation of the nozzle while coupled to the rotating axis. The outside rotor case may have a larger radius than a radius of the inside rotor to accommodate the inside rotor therein, and have an opening hole through which the rotating axis passes. The nozzle may be configured to rotate on the rotating axis thereof, and the rotating axis may be configured to revolve around a center of the outside rotor case.

The outside rotor case may include a plurality of outside protrusions protrudedly formed in an inward radial direction from a circumference of the opening hole.

The inside rotor may include a projection and a plurality of inside protrusions. The projection may be protruded from an upper surface of the inside rotor and formed in a way to penetrate the opening hole of the outside rotor case. The plurality of inside protrusions may be protrudedly formed in an outward radial direction along a circumference of the projection from a side surface of the projection.

In accordance with another aspect, a nozzle assembly includes a case, a washing tub, and at least one nozzle assembly. The washing tub may be disposed at an inside the case and accommodate dishware. The at least one nozzle assembly may be red to spray wash water to an inside the washing tub to clean the dishware at an inside the washing tub. The nozzle assembly may include a nozzle, a rotor, a rotor case and an eccentric rotation guide. The nozzle may be configured to rotate on a rotating axis thereof. The rotor may be configured to rotate according to a rotation of the nozzle while coupled to the rotating axis. The rotor case may be configured to accommodate the rotor and have an opening hole through which the rotating axis passes. The eccentric rotation guide may be formed in a circular-shape plate and have a rotor coupling hole formed in a way that the rotor is coupled while being positioned at a side away from a center of the eccentric rotation guide.

As a rotating axis of a nozzle revolve while rotating along with the rotation of the nozzle, wash water is reached to a corner of a washing tub.

By the driving force alone caused by the reaction of the wash water sprayed from a nozzle, the rotating and the revolving of the rotating axis are realized, and thus, a separate driving force is not needed.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
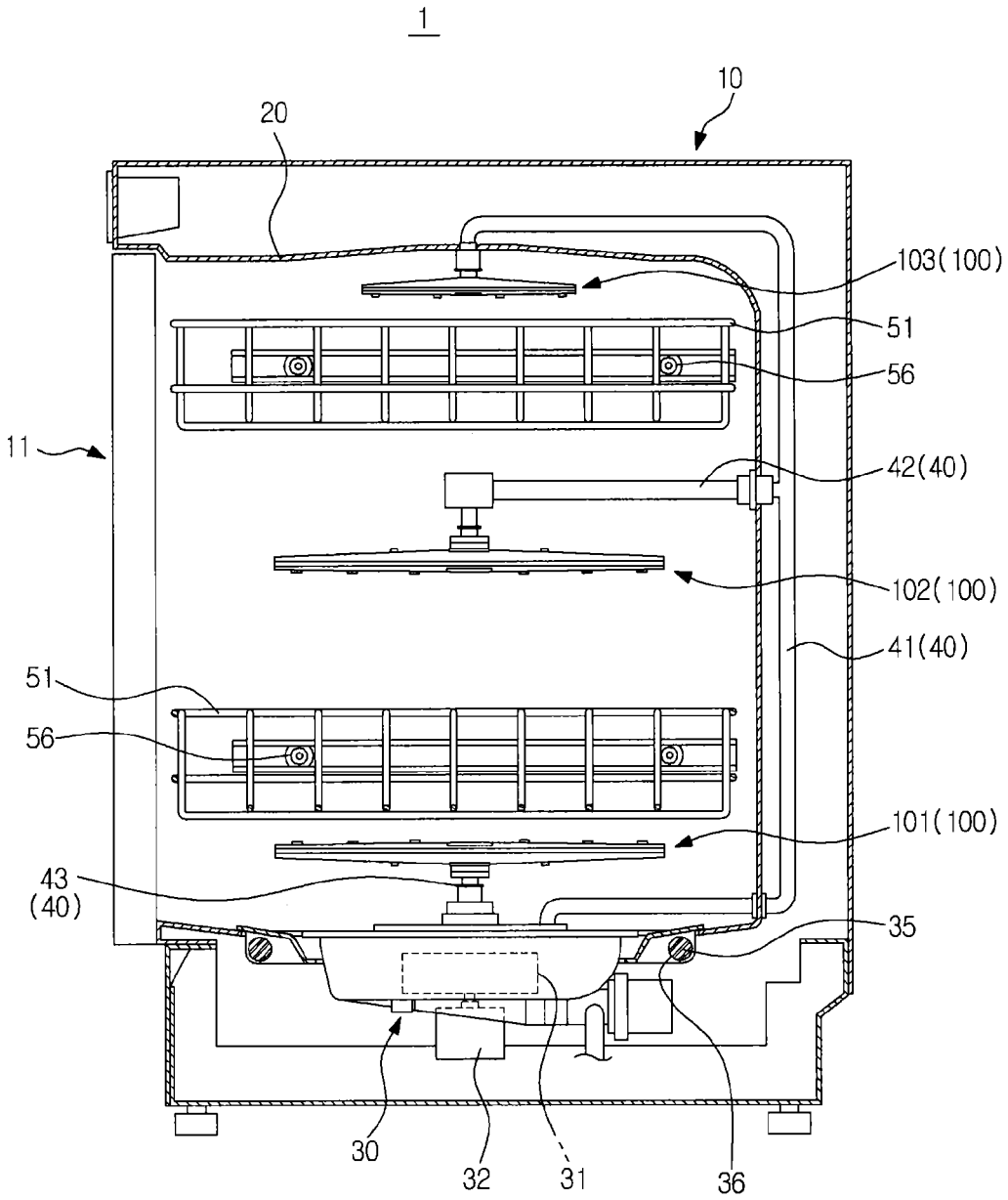
FIG. 1 is a drawing illustrating a structure of a dishwasher in accordance with one embodiment.

Reference will now be made in detail to the embodiments, examples of which are illustrated in the accompanying drawings, wherein like reference numerals refer to like elements throughout.

FIG. 1 is a drawing illustrating a structure of a dishwasher in accordance with one embodiment.

As illustrated on FIG. 1, a dishwasher 1 includes a body 10 forming an exterior thereof, a washing tub 20 provided at an inside the body 10 and forming a washing space of dishware, and a sump 30 provided at a lower portion of the washing tub 20 and at which wash water is stored.

A front surface of the body 10 is open is open in the front to allow dishware to be stored or withdrawn from wash tub 20. The front surface of the body 10 is provided with a door 11, a lower portion of which is hingedly coupled to the front surface of the body 10 to open/close the washing tub 20.

At an inside the washing tub 20, a pair of dishware baskets 51, each is provided with an accommodating part having a upper side thereof open for dishware to be stored, are installed at an upper portion and a lower portion of the washing tub 20 in a way to move forward/backward. The dishware basket 51, by at least one rack 56 configured to slidably support the dishware basket 51, is put into/taken out from the washing tub 20 through the front of the body 10.

The dishware basket 51 is formed by wires formed in, for example, a grid pattern, such that the dishware stored at an inside thereof is exposed to an outside and cleaned.

At least one nozzle assembly 100 is mounted and rotatively installed at an upper side, a lower side, and a central side of the two dishware baskets 51 at an inside the washing tub 20, and configured to spray water for the dishware stored in the dishware baskets 51 is cleaned. At least the one nozzle assembly 100 may include an upper portion nozzle 103, a central nozzle 102, and a lower portion nozzle 101. On the drawing, the total of three nozzle assemblies 100 are illustrated, but having more or less than three nozzle assemblies 100 may be included in an embodiment of the present disclosure.

A heater 35 to heat wash water and a heater installing groove 36 may be formed at the washing tub 20. The heater installing groove 36 is provided at a bottom of the washing tub 20, and the heater 35 is installed at the heater installing groove 36.

The sump 30 is provided at a center of a bottom of the washing tub 20 to collect wash water and pump the collected wash water. The sump 30 includes a cleaning pump 31 configured to pump at high pressure, and a pump motor 32 to drive the cleaning pump 31.

The cleaning pump 31 is configured to pump wash water to the upper portion nozzle 103 through a first supply pipe 41, and through a second supply pipe 42 branching from the first supply pipe 41, the cleaning pump 31 pumps wash water to the central nozzle 102. Through a third supply pipe 43, wash water is pumped to the lower portion nozzle 101.

The sump 30 may include a turbidity sensor (not shown) to detect the pollution level of wash water. A control unit (not shown) of the dishwasher 1, by using the turbidity sensor (not shown), detects the pollution level of wash water, and may control the number of frequencies in processing a cleaning cycle and a rinsing cycle. That is, in a case when pollution level is high, a cleaning or rinsing cycle is increased, and in a case when pollution level is low, a cleaning or rinsing cycle may be decreased.

Figure 2:
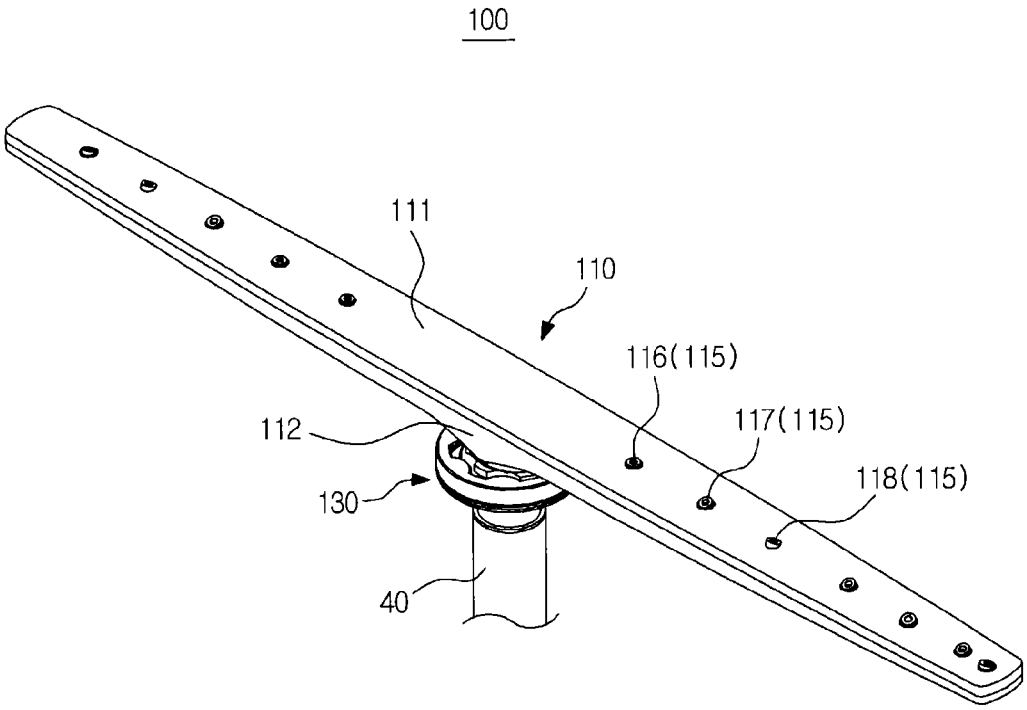
FIG. 2 is a drawing illustrating a nozzle assembly in accordance with one embodiment of the present disclosure.
Figure 3:
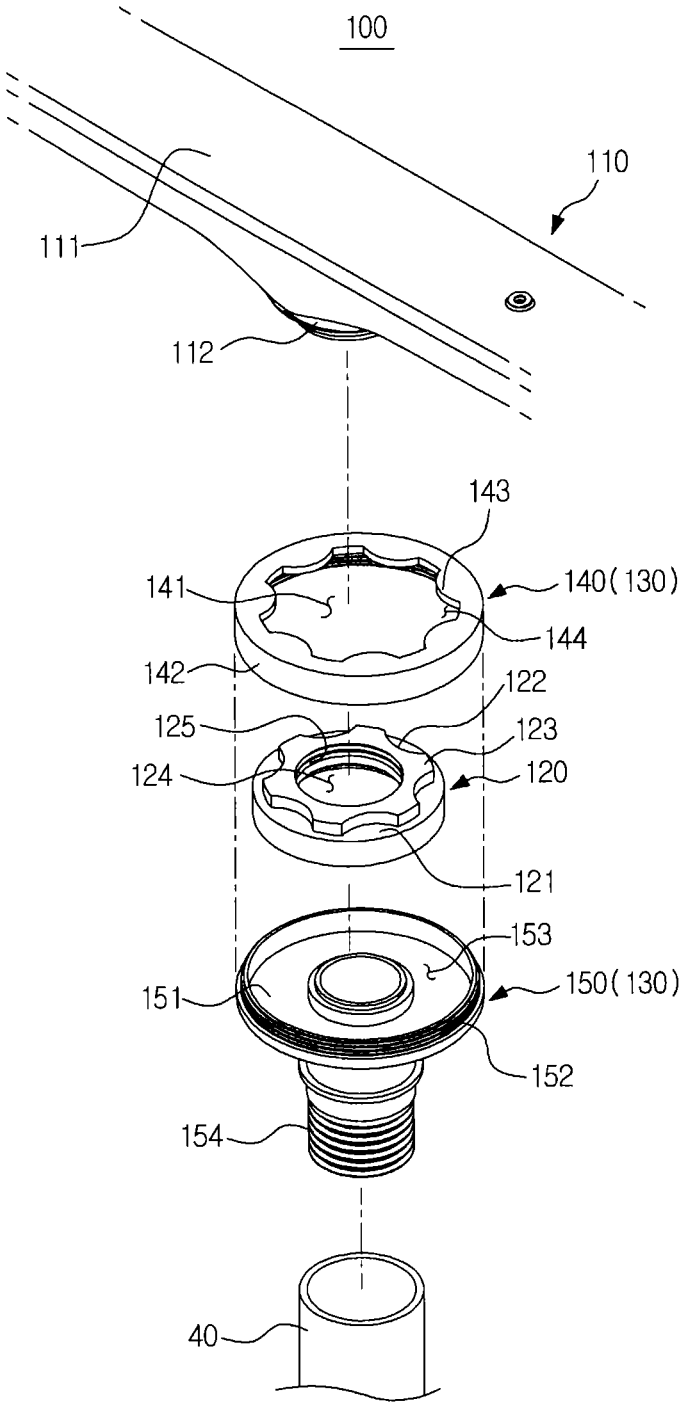
FIG. 3 is a perspective view of the structure of the nozzle assembly on FIG. 2.

FIG. 2 is a drawing illustrating a nozzle assembly in accordance with one embodiment of the present disclosure, and FIG. 3 is a perspective view of the structure of the nozzle assembly on FIG. 2.

As illustrated on FIGS. 2 to 3, the nozzle assembly 100 includes a nozzle 110, an inside rotor 120 coupled to the nozzle 110 and rotates along with the nozzle 110, and an outside rotor case 130 accommodating the inside rotor 120 and connected to a supply pipe 40.

An upper surface 111 of the nozzle 110 is provided with at least one outlet port 115 (FIG. 6), which is protruded from the upper surface 111, formed thereto A rotating axis 112 is formed while protruded from a central portion of the nozzle 110 toward a lower side. Along the circumference of the side surface of the rotating axis 112, screw threads are formed for the coupling with the inside rotor 120.

A projection 122 is protrudedly formed from an upper surface 121 of the inside rotor 120 toward an upper side. A plurality of inside protrusions 123, while is protruded along the circumference of the side surface of the projection 122 in a radial direction toward an outer side, is formed while each of the plurality of inside protrusion 123 is provided with a gear shape.

As a central portion of the projection 122 is open, a nozzle coupling hole 124 is formed such that the rotating axis 112 of the nozzle 110 of inside rotor 120 is coupled to the nozzle coupling hole 124. An inside surface 125 of the projection 122 is provided with screw threads configured to be coupled to the screw threads formed at the circumference of the rotating axis 112, so that the nozzle 100 is coupled the inside rotor 120.

The outside rotor case 130 is formed as an upper portion cover 140 and a lower portion cover 150 are coupled to each other. The lower portion cover 150 includes a lower portion cover bottom 151 and a lower portion cover side surface 152 protruding from the lower portion cover bottom 151 and forming a rotor accommodation space 153. Along the circumference of the lower portion cover side surface 152, screw threads are formed. A supply pipe coupling part 154 is formed by extending toward a lower side from the lower portion cover bottom 151. As the supply pipe coupling part 154 is inserted into the supply pipe 40, the supply pipe 40 and the outside rotor case 130 are connected to each other.

The upper portion cover 140 is provided with an open upper portion thereof to form an opening hole 141, and the opening hole 141 is surrounded by an upper portion cover side surface 142. At an inner side surface of the upper portion cover side surface 142, screw threads is formed to be coupled to the screw threads of the lower portion cover side surface 152.

A plurality of outside protrusions 143 is formed while being bent in an inward radial direction from an upper portion of the upper portion cover side surface 142. The plurality of outside protrusions as a whole is formed in a shape of a gear. Indentation parts 144, which are shown as indentations relative to the outside protrusions 143 protrudedly formed, are formed in between the outside protrusions 143.

The projection 122 of the inside rotor 120 is disposed in a way to penetrate the opening hole 141 of the outside rotor case 130. Thus, the inside protrusions 123 of the inside rotor 120 are disposed in between the indentation parts 144 of the outside rotor case 130. Furthermore, the rotating axis 112 of the nozzle 110, which is coupled to the nozzle coupling hole 124 of the projection 122, is disposed to penetrate the opening hole 141.

The number of the inside protrusions 123 of the inside rotor 120 is one less than the number of the indentation parts 144 of the outside rotor case 130. The forming of the inside rotor 120 and the outside rotor case 130 as such is referred to as a gerotor.

In the embodiment, for example, the total of six of the inside protrusions 123 and the total of seven of the outside protrusions 143 are formed, but as long as the number of the inside protrusions 123 of the inside rotor 120 is one less than the number of the indentation parts 144 of the outside rotor case 130, the setting of the number of the inside protrusions 123 and the outside protrusions 143 is not set.

By controlling the number of the inside protrusions 123 and the outside protrusions 143, the revolving path of the inside rotor 120 that revolves around the opening hole 141 of the outside rotor case 130 may be variably changed.

Figure 4:
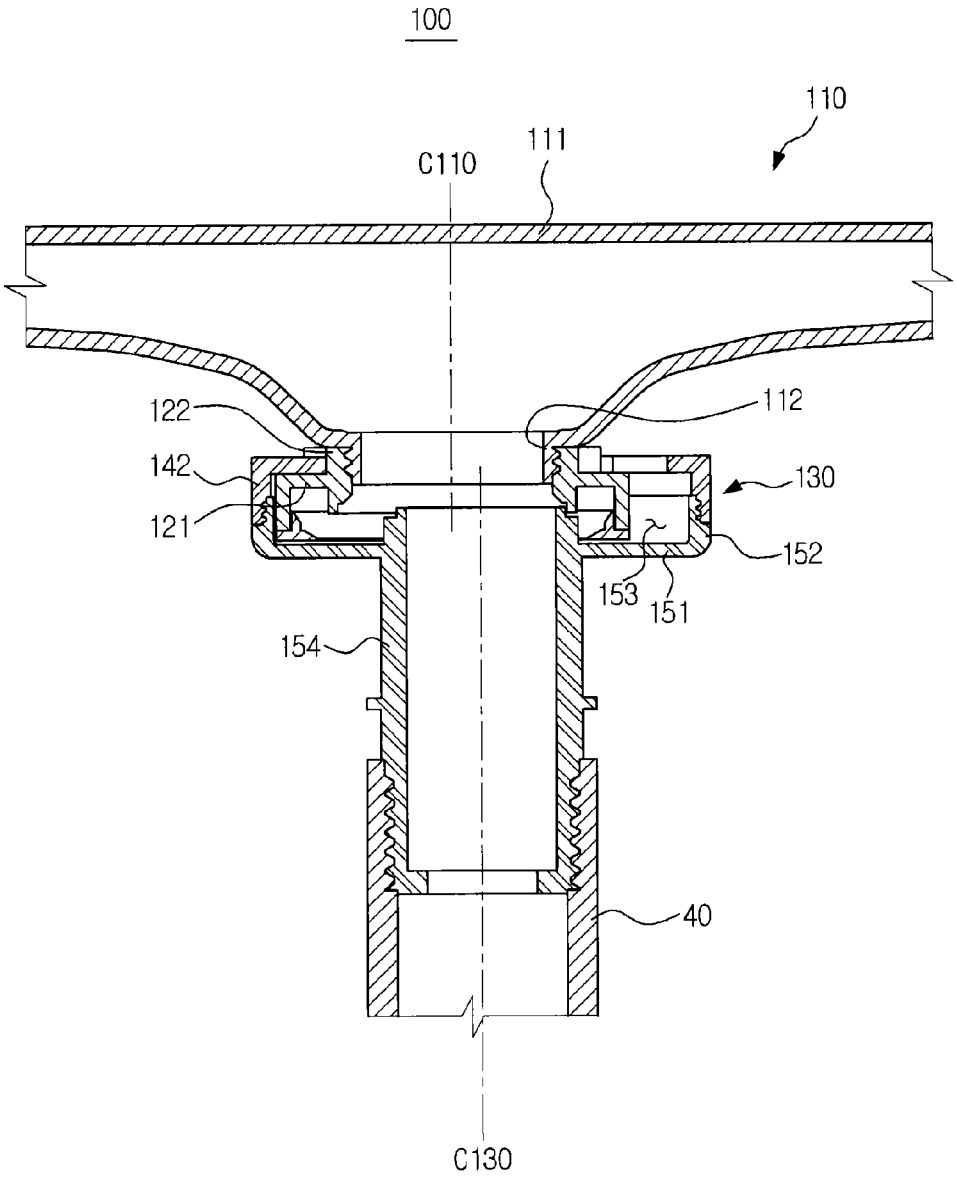
FIG. 4 is a cross-sectional view of the nozzle assembly on FIG. 2.
Figure 5:
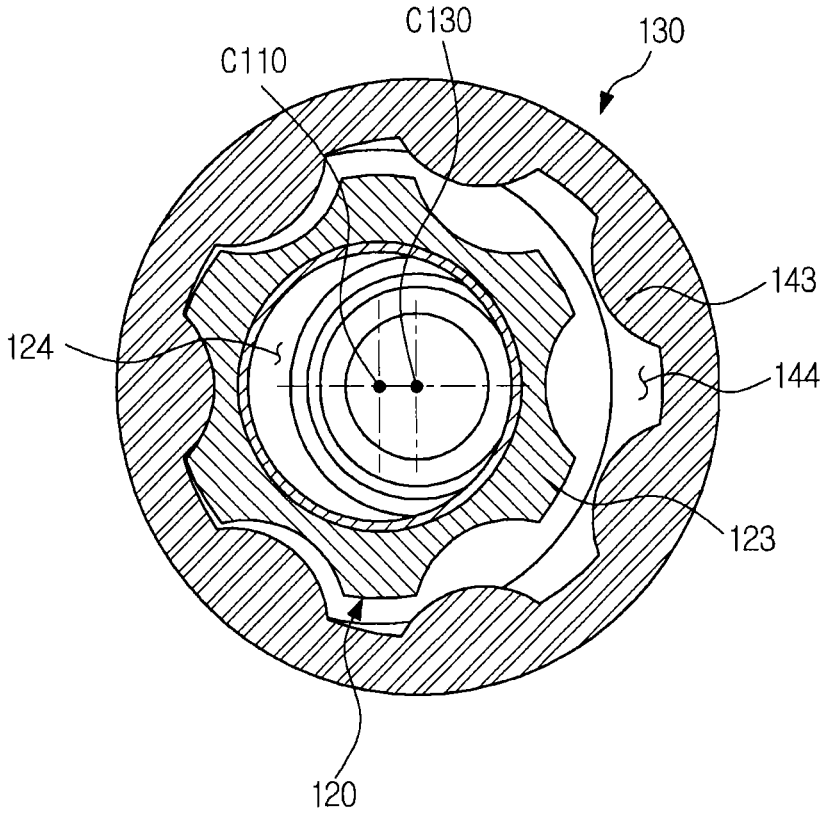
FIG. 5 is a drawing illustrating an inside rotor and an outside rotor case of the nozzle assembly on FIG. 2.

FIG. 4 is a cross-sectional view of the nozzle assembly on FIG. 2, and FIG. 5 is a drawing illustrating an inside rotor and an outside rotor case of the nozzle assembly on FIG. 2.

As illustrated on FIGS. 4 to 5, the inside rotor 120 rotates, as the inside protrusions are positioned at the indentation parts 144 of the outside rotor case 130. Thus, the rotating axis 112 of the nozzle 110 and the center of a rotation C100 of the inside rotor 120, as well as the center of a rotation C130 of the outside rotor case 130 are present on different lines from one another while not forming a straight line. That is, the nozzle 110 and the inside rotor 120 are disposed in a way that the center of the rotation C110 of the rotating axis 112 is disposed at a position spaced away from the center of the rotation C130 of the outside rotor case 130.

If the inside rotor 120 and the nozzle 110 are disposed as such, the rotating axis 112 as well rotates along the circumference of the opening hole 141 of the outside rotor case 130 by the rotation of the nozzle 110, and thus, the rotating axis 112 is simultaneously rotated and revolves.

By the rotation of the rotating axis 112 as such, the moving range of the nozzle 110 is also widened, and as the movement of the nozzle 110 is larger, wash water may be sprayed to each and every corner of an inside the washing tub 20 (FIG. 1).

Figure 6:
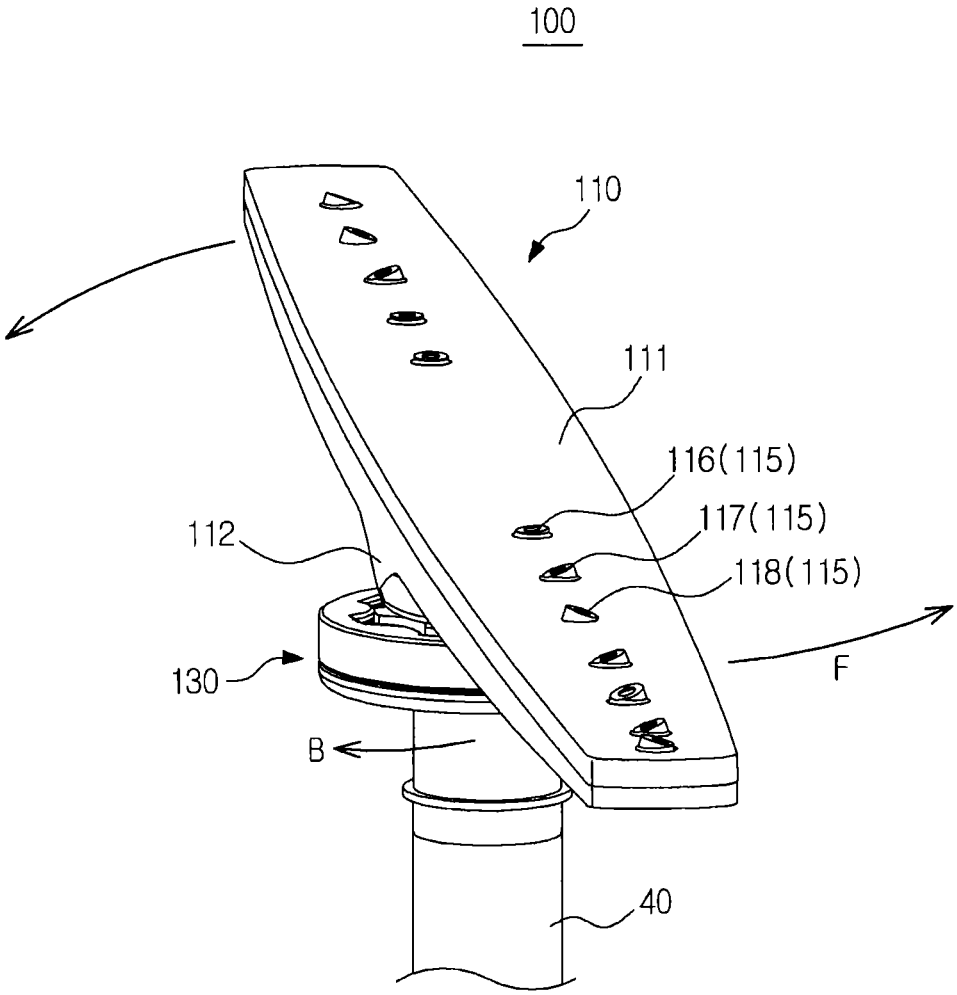
FIG. 6 is a drawing illustrating a rotation of the nozzle assembly on FIG. 2.

FIG. 6 is a drawing illustrating a rotation of the nozzle assembly on FIG. 2.

As illustrated on FIG. 6, a plurality of outlet ports 115 is formed at the upper surface 111 of the nozzle 110. The outlet ports 115 includes a third outlet port 116 formed to spray wash water in a perpendicular direction to the upper surface 111, a first outlet port 118 formed to face a first direction F from the upper surface 111, such that wash water is sprayed while inclined by a predetermined angle with respect to a perpendicular direction from the upper surface 111 toward the first direction F, and a second outlet port 117 formed to face a second direction B from the upper surface 111, such that wash water is sprayed while inclined by a predetermined angle with respect to a perpendicular direction from the upper surface 111 toward the second direction B.

In accordance with the embodiment, by having one side of the nozzle 110 as a reference, the total of four units of the second outlet port 117 facing the second direction B is formed, and the total of two units of the first outlet port 118 facing the first direction F is formed. Thus, the number of the second outlet port 117 is greater than the number of the first outlet port 118. By the sum of the forces caused by the reaction of the wash water sprayed from the outlet ports 115, the nozzle 110 is rotated toward the first direction F.

The number of each of the outlet ports 115 formed differently from the illustration on the drawing may be included in the aspect of the present disclosure. Furthermore, the rotating of the nozzle 110 rotating toward the second direction B as more number of the first outlet port 118 is formed may also be included in the aspect of the present disclosure.

As the nozzle 110 is rotated as such, accordingly, the inside rotor 120 also is rotated.

Figure 7:
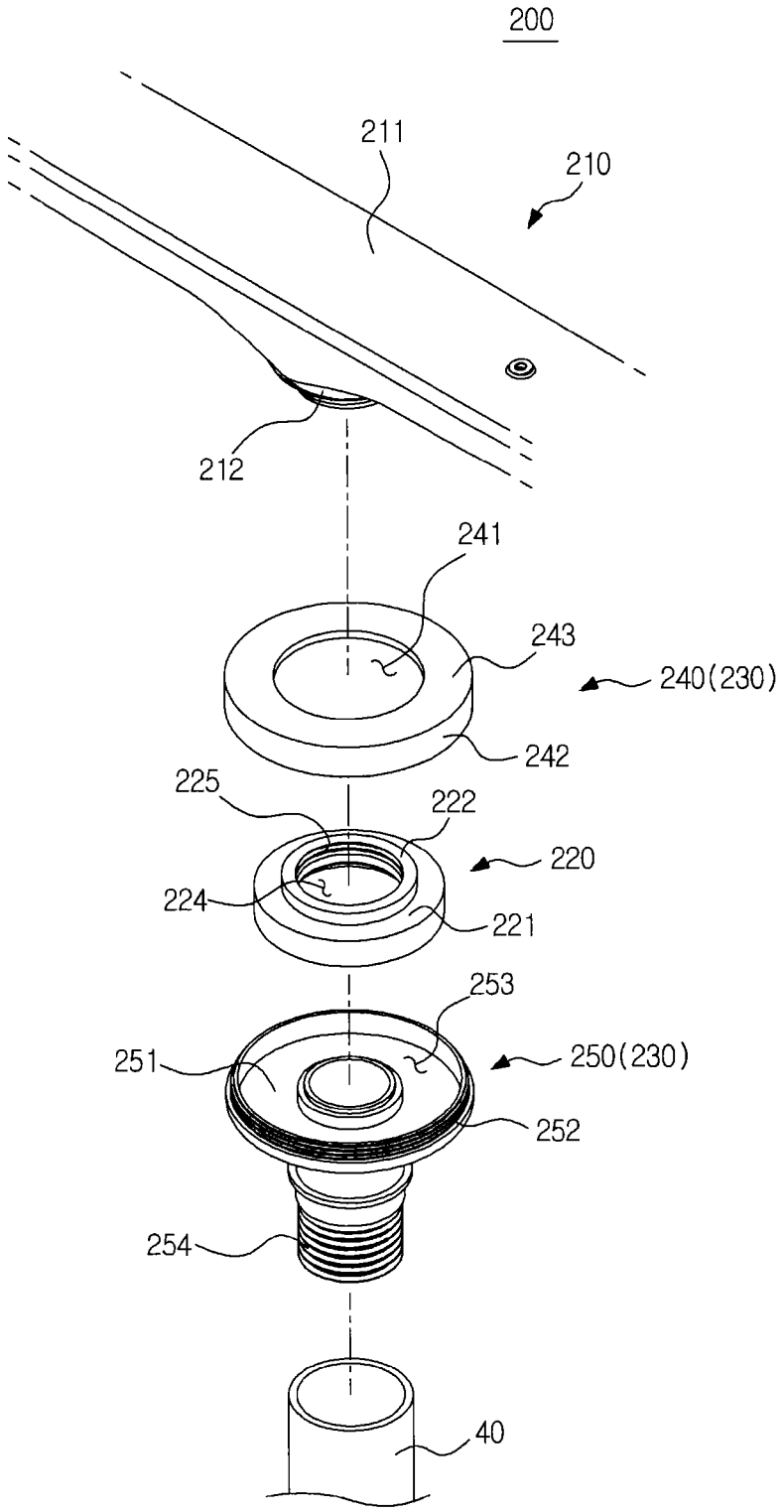
FIG. 7 is a drawing illustrating a structure of a nozzle assembly in accordance with one embodiment.

FIG. 7 is a drawing illustrating a structure of a nozzle assembly in accordance with another embodiment of the present disclosure.

As illustrated on FIG. 7, a nozzle assembly 200 includes a nozzle 210, an inside rotor 220 coupled to the nozzle 210 and rotates along with the nozzle 210, and an outside rotor case 230 accommodating the inside rotor 220 and connected to the supply pipe 40. The outside rotor case 230 is not rotated, but is configured to limit the rotation path of the inside rotor 220 while performing a role as a case to accommodate the inside rotor 220.

A rotating axis 212 is formed while protruded from a central portion of the nozzle 210 toward a lower side. Along the circumference of the side surface of the rotating axis 212, screw threads are formed for the coupling with the inside rotor 220.

A projection 222 is protrudedly formed from an upper surface 221 of the inside rotor 220 toward an upper side. A central portion of the projection 222 is open, and a nozzle coupling hole 224 is formed. An inside surface of the projection 222 is provided with screw threads formed coupled to the screw threads formed at the circumference of the rotating axis 212 such that the nozzle 210 is coupled to the inside rotor 220. As the rotating axis 212 is inserted into the nozzle coupling hole 224, the nozzle 210 is coupled to the inside rotor 220 by the screw threads of the rotating axis 212 and the projection 212.

The outside rotor case 230 is formed as an upper portion cover 240 and a lower portion cover 250 are coupled to each other. The lower portion cover 250 includes a lower portion cover bottom 251 and a lower portion cover side surface 252 protruding from the lower portion cover bottom 251 and forming a rotor accommodation space 253. Along the circumference of the lower portion cover side surface 252, screw threads are formed. A supply pipe coupling part 254 is formed while extended toward a lower side from the lower portion cover bottom 251. As the supply pipe coupling part 254 is inserted into the supply pipe 40, the supply pipe 40 and the outside rotor case 230 are connected to each other.

The upper portion cover 240 includes an upper portion cover side surface 242 forming a side surface circumference of the upper portion cover 240, and an upper portion cover upper surface 243 formed while bent from an upper portion of the upper portion cover side surface 242 toward an inner side. The central portion of the upper portion cover upper surface 243 is open, and forms an opening hole 241.

The projection 222 of the inside rotor 220 and the rotating axis 212 coupled to the nozzle coupling hole 224 of the projection 222 are disposed to penetrate the opening hole 241 of the outside rotor case 230. Thus, the projection 222 may be freely moved at an inside the opening hole 241 of the outside rotor case 230.

By the rotation of the nozzle 210, the inside rotor 220 also rotates, and at the same time, freely moves at an inside the opening hole 241. Accordingly, the nozzle 210 is not rotated at a fixed position, but also revolves around. However, as the projection 222 of the inside rotor 220 is engaged at an inside the opening hole 241, the movement of the inside rotor 220 is limited by the shape and size of the opening hole 241.

Figure 8:
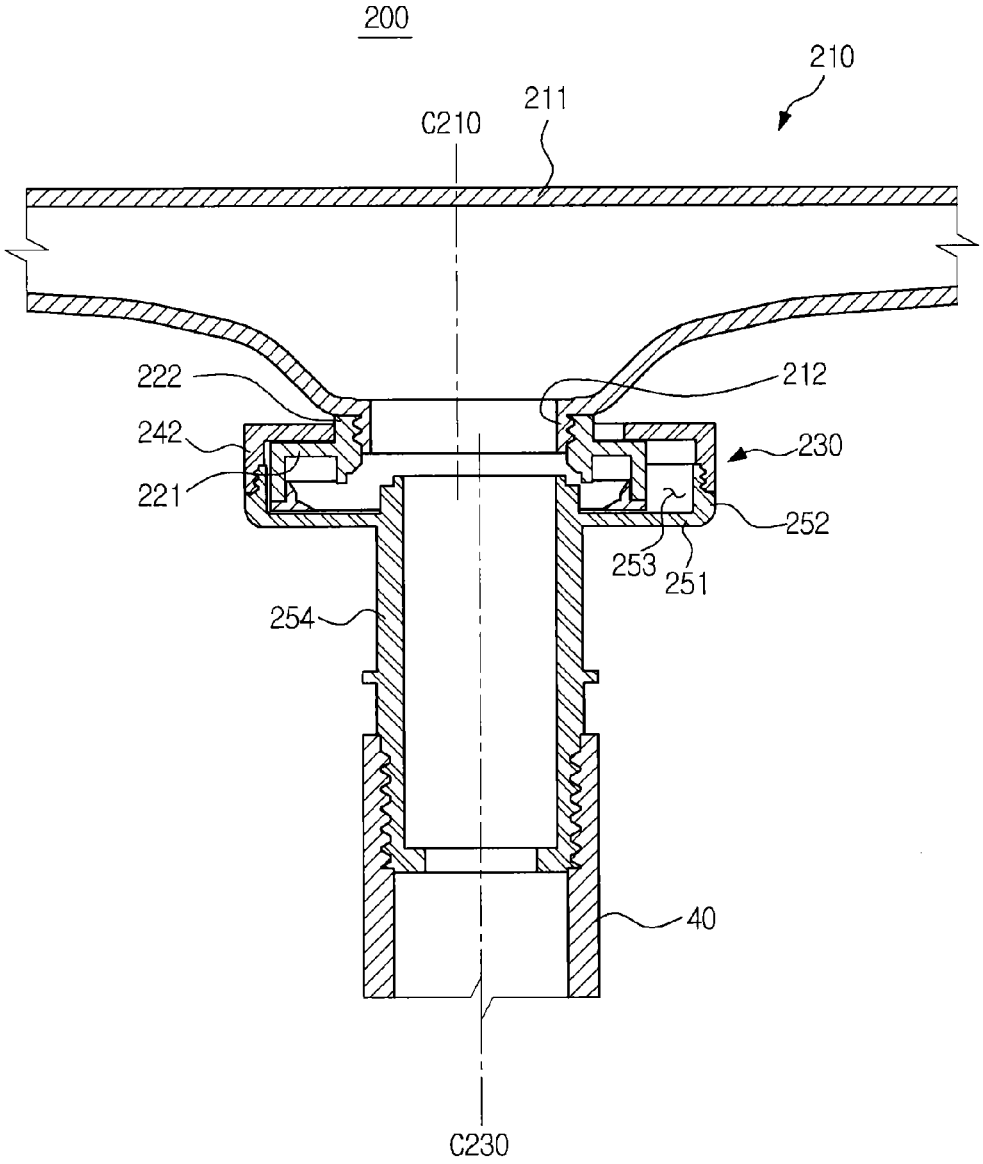
FIG. 8 is a cross-sectional view of the nozzle assembly on FIG. 7.
Figure 9:
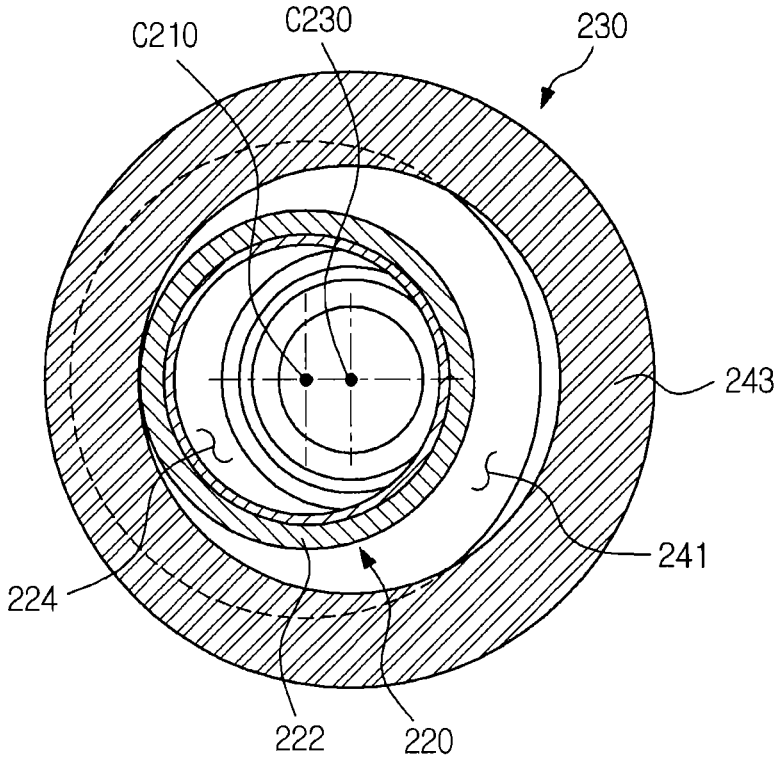
FIG. 9 is a drawing illustrating an inside rotor and an outside rotor case of the nozzle assembly on FIG. 7.

FIG. 8 is a cross-sectional view of the nozzle assembly on FIG. 7, and FIG. 9 is a drawing illustrating an inside rotor and an outside rotor case of the nozzle assembly on FIG. 7.

As illustrated on FIGS. 8 to 9, the center of the rotation C210 of the nozzle 210 and the center of the rotation C230 of the outside rotor case 230 may be present on different lines from one another, while not forming a straight line, as the inside rotor 220 is freely moved at an inside the outside rotor case 230 and the opening hole 241. And, depending on a circumstance, the center of the rotation C210 of the nozzle 210 and the center of the outside rotor case 230 may be placed on a straight line. With this possible irregular revolution of the nozzle 210 around the center of the outside rotor case 230, washing water spray pattern is varied.

As the nozzle 210 may be able to move, while rotating on the center of rotation C210 at an inside the opening hole 241 according to the movement of the inside rotor 220, wash water may be able to be sprayed to each and every corner of the inside the washing tub 20 (FIG. 1).

Figure 10:
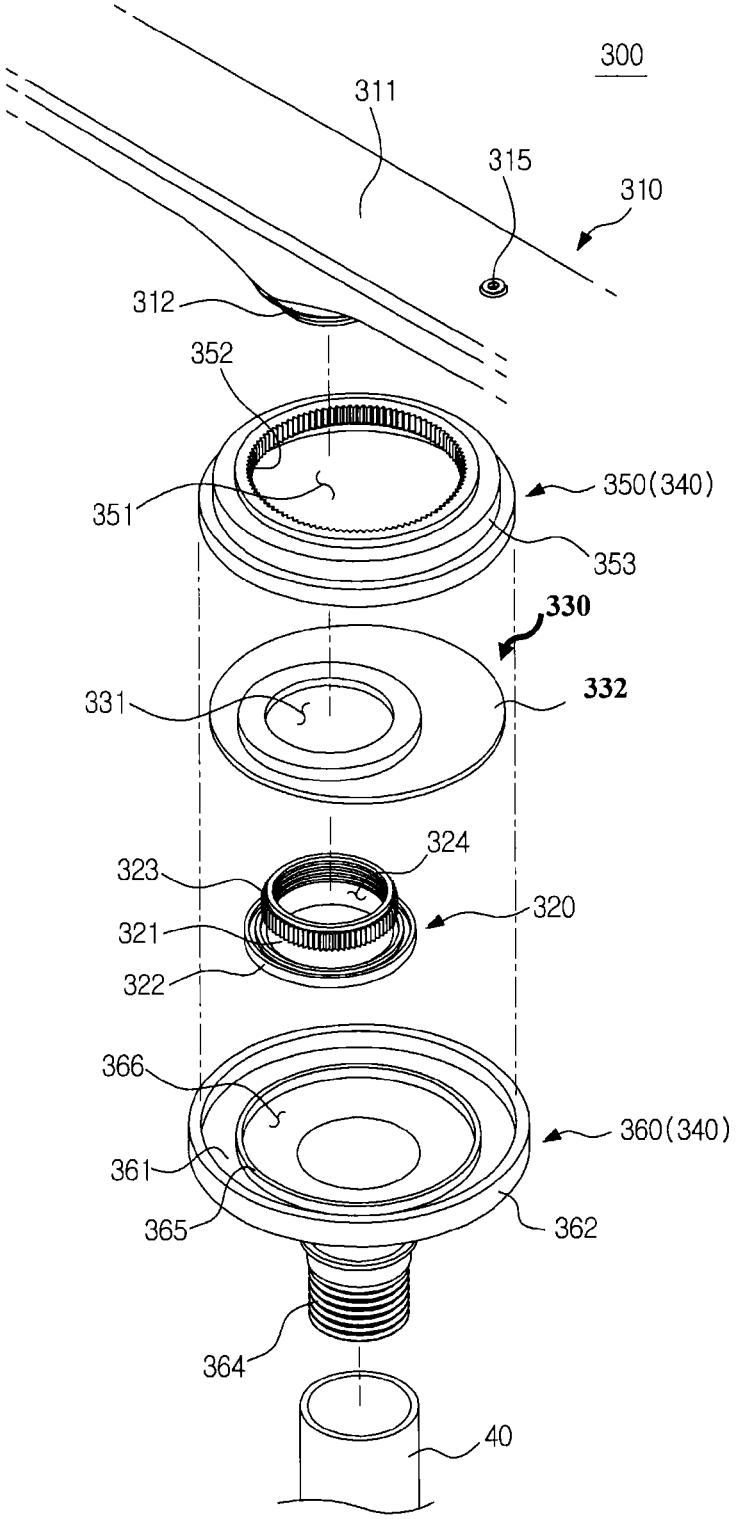
FIG. 10 is a drawing illustrating a structure of a nozzle assembly in accordance with one embodiment.

FIG. 10 is a drawing illustrating a structure of a nozzle assembly in accordance with another embodiment of the present disclosure.

As illustrated on FIG. 10, a nozzle assembly 300 includes a nozzle 310, a rotor 320 configured to rotate along with the nozzle 310 while coupled to the nozzle 310, an eccentric rotation guide 330 coupled to the rotor 320 and configured for the rotor 320 to eccentrically rotate, and a rotor case 340 accommodating the rotor 320 and the eccentric rotation guide 330.

An upper surface 311 of the nozzle 310 is provided with at least one outlet port 315. The description of the shape of the outlet port 315 is replaced with the description provided in the above embodiment.

A rotating axis 312 is formed while protruded from a central portion of the nozzle 310 toward a lower side. Along the circumference of the side surface of the rotating axis 312, screw threads are formed for the coupling with the rotor 320.

The rotor 320 includes a bottom panel 322, and a projection 321 protrudedly formed from the bottom panel 322 toward an upper side.

A central portion of the rotor 320 is open to form a nozzle coupling hole 324 such that the rotating axis 312 of the nozzle 310 is coupled to the rotor 320. An inside surface of the projection 321 is provided with screw threads, which correspond to the screw threads formed at the circumference of the rotating axis 312, formed thereto.

Inside teeth 323 are protrudedly formed in a radial direction along the circumference of the outer surface of the projection 321 toward an outside.

The rotor 320 is rotatably coupled to the eccentric rotation guide 330. The eccentric rotation guide 330 includes a circular-shape plate 332, and a rotor coupling hole 331 formed as some portion of the plate 332 is open. The rotor coupling hole 331 is formed while being eccentrically placed at a position at a side away from the center of the plate 332. The rotor 320 is rotatably coupled to the rotor coupling hole 331 while the projection 321 of the rotor 320 penetrates the rotor coupling hole 331.

As the rotor coupling hole 331 is coupled while eccentrically placed from the center of the eccentric rotation guide 330 to an edge of the plate 332, in a case when the rotor 320 is rotated by the rotation of the nozzle 310, the rotor 320 is not rotated at a fixed position, but revolves around the center of the plate 332.

A rotor case 340 is formed as an upper portion case 350 and a lower portion case 360 are coupled to each other. The lower case 360 has a bottom 361 and a side surface 362 protruding from the bottom 361 and forming a rotor accommodation space 366. For example, a circular rib 365 may be provided on the bottom 361 to support the plate 332 so as to reduce a friction between the bottom 361 and the plate 332 while the eccentric rotation guide rotates within the rotor case 340. The rib 365 may have different shapes as long as the rib 365 can support the plate 332 while rotating. The lower portion case 360 is extended toward a lower side from a bottom 361 to form a supply pipe coupling unit 364. As the supply pipe coupling unit 364 is inserted into the supply pipe 40, the supply pipe 40 and the rotor case 340 are connected to each other.

The upper portion case 350 includes an opening hole 351 formed while having the upper portion thereof open, and an upper portion case side surface 353 surrounding the opening hole 351. Outside teeth 352, which correspond to the inside teeth 323 of the rotor 320, are formed at an inner side surface of the upper portion case side surface 353. The inside teeth 323 and the outside teeth 352 are formed to be interlocked to each other, such that the rotor 320 revolve along the opening hole 351 of the upper portion case 350.

Figure 11:
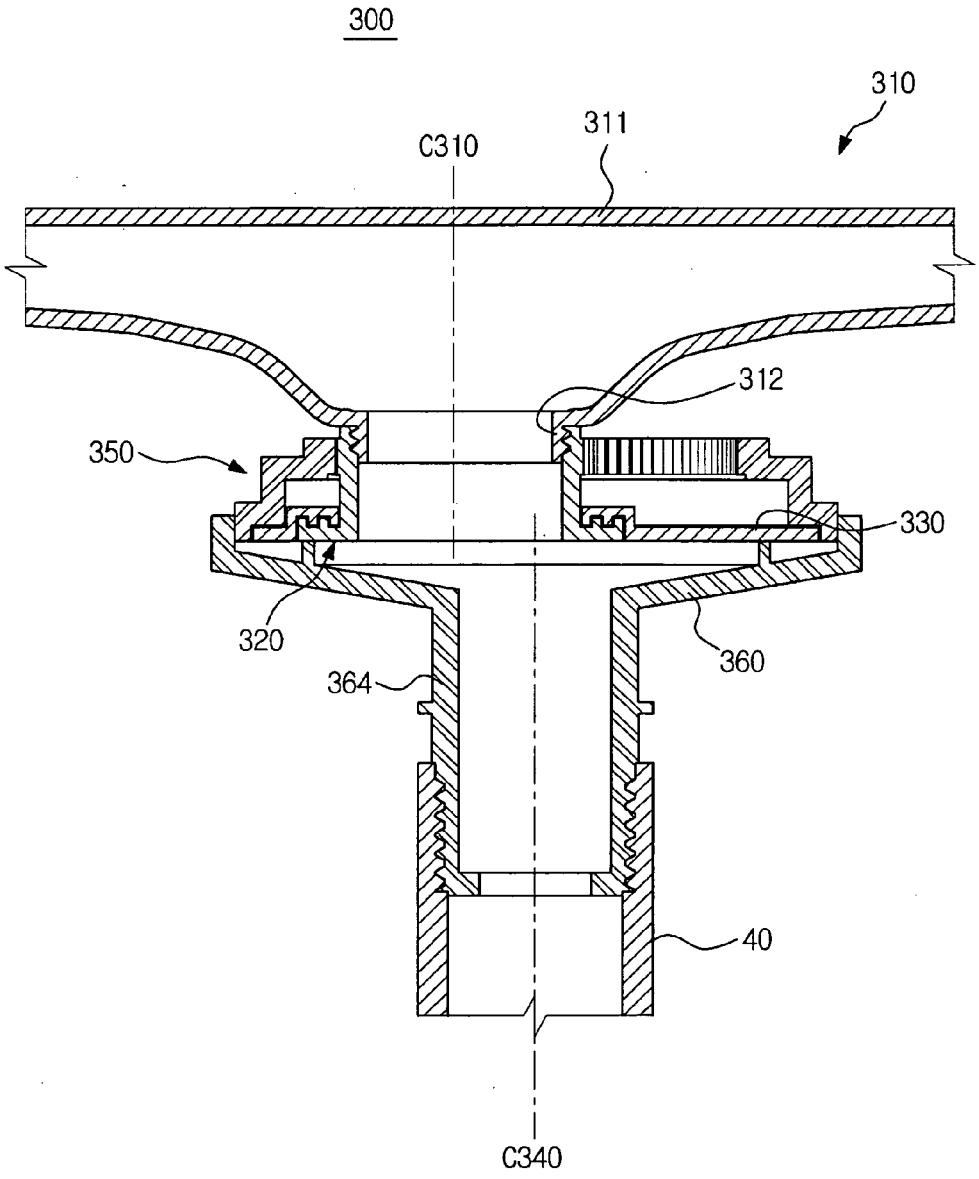
FIG. 11 is a cross-sectional view of the nozzle assembly on FIG. 10.
Figure 12:
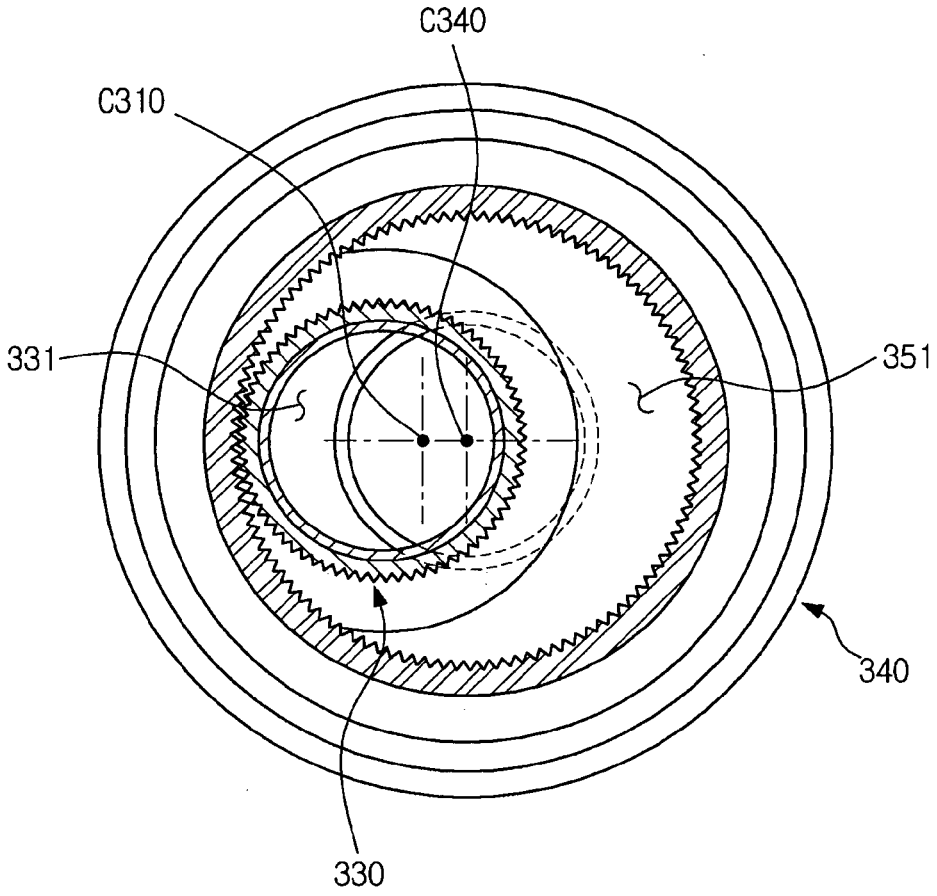
FIG. 12 is a drawing illustrating a rotor and a rotor case of the nozzle assembly on FIG. 10.

FIG. 11 is a cross-sectional view of the nozzle assembly on FIG. 10, and FIG. 12 is a drawing illustrating a rotor and a rotor case of the nozzle assembly on FIG. 10.

As illustrated on FIGS. 11 to 12, the center of the rotation C310 of the nozzle 310 and the eccentric rotation guide 330, as well as the center C340 of the rotor case 340 are not present on a straight line, but are present on different lines from one another. Thus, the nozzle 310 is rotated on the center of rotation C310, and at the same time, the nozzle 310 and the rotor 320 revolve around the center of the eccentric rotation guide 330 and the center C340 of the rotor case 340. According to this structure, irregular revolution of the rotor 320 around the center C340 of the rotor case 340 can be prevented by the eccentric rotation guide. It is apparent to apply the eccentric rotation guide to previously described embodiments as shown in FIGS. 3 and 7 in order to make sure a rotation and a regular revolution of the nozzle of the dishwasher around the center of the supply pipe 40.

Through the movement as such, wash water may be sprayed to each and every corner of an inside the washing tub 20 (FIG. 1).

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A nozzle assembly, comprising:

a nozzle having a rotating axis;

an inside rotor coupled to the nozzle and sharing the rotating axis with the nozzle and having a shape of a cylinder and rotating according to a rotation of the nozzle;

an outside rotor case having a larger radius than a radius of the inside rotor to accommodate the inside rotor therein, the outside rotor case not being rotatable, and having an opening hole through which the rotating axis passes; and an eccentric rotation guide having a circular-shape plate and an inside rotor coupling hole eccentric from a center of the plate, the inside rotor being rotatably coupled to the eccentric rotation guide through the inside rotor coupling hole, wherein the inside rotor includes:

a portion of the inside rotor is contained within the outside rotor case, and a projection protruding from an upper surface of the inside rotor and extending vertically above the outside rotor case, wherein the rotating axis of the nozzle shifts along an inner circumference of the opening hole, and wherein the eccentric rotation guide is contained rotatably within the outside rotor case.

2. The nozzle assembly of claim 1, wherein:

the rotating axis of the nozzle, while rotating, revolves around a center of the outside rotor case.

3. The nozzle assembly of claim 1, wherein the projection of the inside rotor protrudes from the upper surface of the inside rotor and is formed to pass through the opening hole of the outside rotor case.

4. The nozzle assembly of claim 3, wherein:

the inside rotor further comprises a plurality of inside protrusions protrudedly formed in an outer radial direction along a circumference of the projection at a side surface of the projection.

5. The nozzle assembly of claim 4, wherein:

the outside rotor case comprises a plurality of outside protrusions protrudedly formed in a radial inward direction from the circumference of the opening hole around which the plurality of inside protrusions of the inside rotor rotate.

6. The nozzle assembly of claim 5, wherein:

a number of the plurality of inside protrusions is less than a number of the plurality of outside protrusions.

7. The nozzle assembly of claim 5, wherein:

the plurality of inside protrusions are formed in a corresponding shape to an indentation part formed in between the plurality of outside protrusions.

8. The nozzle assembly of claim 1, wherein:

the nozzle comprises an outlet port through which wash water is sprayed.

9. The nozzle assembly of claim 8, wherein:

the outlet port is provided in a way that a direction of the wash water sprayed from an upper surface of the nozzle is formed in an inclined manner with respect to the upper surface of the nozzle.

10. The nozzle assembly of claim 9, wherein:

the nozzle and the inside rotor are rotated by a reaction against the wash water sprayed from the outlet port.

11. The nozzle assembly of claim 1, wherein the outside rotor case further comprises a rib to support the eccentric rotation guide.

12. The nozzle assembly of claim 1, wherein the outside rotor case, which includes a plurality of outside protrusions, is fixed to a supply pipe of a dish washer.

13. A nozzle assembly, comprising:

a nozzle having a rotating axis;

a rotor coupled to the nozzle and sharing the rotating axis with the nozzle and configured to rotate according to a rotation of the nozzle;

a rotor case not being rotatable, the rotor case being configured to accommodate the rotor; and an eccentric rotation guide having a circular-shape plate and a rotor coupling hole eccentric from a center of the plate, the rotor being rotatably coupled to the eccentric rotation guide through the rotor coupling hole, wherein the eccentric rotation guide is contained rotatably within the rotor case, and wherein the rotating axis of the nozzle, by the eccentric rotation guide, shifts along a circumference of an opening hole of the rotor case.

14. The nozzle assembly of claim 13, wherein:

the rotor has inside teeth protrudedly formed in an outward radial direction along a circumference of a side surface of the rotor, and the rotor case has outside teeth protrudedly formed along the circumference of the opening hole in an inward radial direction in a corresponding shape to the inside teeth.

15. The nozzle assembly of claim 14, wherein the number of the inside teeth of the rotor is less than the number of the outside teeth of the rotor case.

16. The nozzle assembly of claim 13, wherein:

the nozzle comprises an outlet port through which wash water is sprayed.

17. The nozzle assembly of claim 16, wherein:

the outlet port is provided in a way that a direction of the wash water sprayed from an upper surface of the nozzle is formed in an inclined manner with respect to the upper surface of the nozzle.

18. The nozzle assembly of claim 17, wherein:

the nozzle and the rotor are rotated by a reaction against the wash water sprayed from the outlet port.

19. The nozzle assembly of claim 13, wherein the rotor case further comprises a rib to support the eccentric rotation guide.

20. A dishwasher, comprising:

a case;

a washing tub disposed inside the case and accommodating dishware; and at least one nozzle assembly configured to spray wash water inside of the washing tub to clean the dishware inside of the washing tub, wherein the nozzle assembly comprises:

a nozzle having a rotating axis;

an inside rotor coupled to the nozzle and having a shape of a cylinder and configured to rotate according to a rotation of the nozzle;

an outside rotor case having a larger radius than a radius of the inside rotor to accommodate the inside rotor therein, the outside rotor case not being rotatable, and having an opening hole through which the rotating passes; and an eccentric rotation guide having a circular-shape plate and an inside rotor coupling hole eccentric from a center of the plate, the inside rotor being rotatably coupled to the eccentric rotation guide through the inside rotor coupling hole, wherein the inside rotor includes:

a portion of the inside rotor is contained within the outside rotor case, and a projection protruding from an upper surface of the inside rotor and extending vertically above the outside rotor case, wherein the nozzle is configured to rotate on the vertical rotating axis thereof, and an axis of the inside rotor is configured to shift around an axis of the outside rotor case; and wherein the eccentric rotation guide is contained rotatably within the outside rotor case.

21. The dishwasher of claim 20, wherein:

the outside rotor case comprises a plurality of outside protrusions protrudedly formed in an inward radial direction toward a center of the outside rotor case.

22. The dishwasher of claim 20, wherein the projection of the inside rotor protrudes from the upper surface of the inside rotor and formed in a way to penetrate the opening hole of the outside rotor case, and a plurality of inside protrusions protrudedly formed in an outward radial direction along a circumference of the projection from a side surface of the projection.

23. A dishwasher, comprising:

a case;

a washing tub disposed inside the case and accommodating dishware; and at least one nozzle assembly configured to spray wash water inside the washing tub to clean the dishware inside the washing tub, wherein the nozzle assembly comprises:

a nozzle having a rotating axis;

a rotor coupled to the nozzle and configured to rotate according to a rotation of the nozzle;

a rotor case configured to accommodate the rotor, the rotor case not being rotatable, and having an opening hole through which the rotating axis passes; and an eccentric rotation guide having a circular-shape plate and a rotor coupling hole eccentric from a center of the plate, the rotor being rotatably coupled to the eccentric rotation guide through the rotor coupling hole, wherein the eccentric rotation guide is contained rotatably within the rotor case.

24. A nozzle assembly, comprising:

a nozzle having a rotating axis;

a rotor coupled to the nozzle and having a shape of a cylinder and configured to rotate according to a rotation of the nozzle;

a rotor case having a larger radius than a radius of the rotor to accommodate the rotor therein, being fixed with respect to a washing tub while not being rotatable, and having an opening hole through which the rotating axis passes; and an eccentric rotation guide having a circular-shape plate and a rotor coupling hole eccentric from a center of the plate, the rotor being rotatably coupled to the eccentric rotation guide through the rotor coupling hole, wherein the rotor is configured to move within the rotor case while the nozzle rotates on the rotating axis thereof, and wherein the eccentric rotation guide is contained rotatably within the rotor case.

25. The nozzle assembly of claim 24, wherein the rotor has inside teeth protrudedly formed in an outward radial direction along a circumference of a side surface of the rotor, and the rotor case has outside teeth protrudedly formed along the circumference of the opening hole in an inward radial direction in a corresponding shape to the inside teeth.

26. The nozzle assembly of claim 25, wherein the number of the inside teeth of the rotor is less than the number of the outside teeth of the rotor case.

27. The nozzle assembly of claim 25, wherein the rotor revolves around a center of the rotor case while the nozzle rotates on the rotating axis thereof.

28. The nozzle assembly of claim 27, wherein the rotor case further comprises a rib to support the eccentric rotation guide.

* * * * *